US011053839B2

(12) United States Patent
Terunuma

(10) Patent No.: US 11,053,839 B2
(45) Date of Patent: Jul. 6, 2021

(54) INTAKE DEVICE OF INTERNAL COMBUSTION ENGINE

(71) Applicant: SUBARU CORPORATION, Tokyo (JP)

(72) Inventor: Nozomu Terunuma, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 6 days.

(21) Appl. No.: 16/375,459

(22) Filed: Apr. 4, 2019

(65) Prior Publication Data

US 2019/0360389 A1 Nov. 28, 2019

(30) Foreign Application Priority Data

May 25, 2018 (JP) ..... JP2018-100436

(51) Int. Cl.
*F02B 31/08* (2006.01)
*F02M 35/10* (2006.01)

(52) U.S. Cl.
CPC ..... *F02B 31/085* (2013.01); *F02M 35/10091* (2013.01); *F02M 35/10255* (2013.01)

(58) Field of Classification Search
CPC ..... F02B 31/085; F02B 31/00; F02B 31/04; F02M 35/10091; F02M 35/10255
See application file for complete search history.

(56) References Cited

U.S. PATENT DOCUMENTS

2004/0065297 A1* 4/2004 Sakai ..... F02M 35/10222 123/308
2004/0226536 A1* 11/2004 Sakai ..... F02F 1/38 123/308
2005/0082028 A1* 4/2005 Akaba ..... F02B 31/085 164/98
2016/0201693 A1* 7/2016 An ..... F04D 29/4213 415/58.4
2016/0333821 A1* 11/2016 Chu ..... F02B 31/04
2017/0067392 A1* 3/2017 Suzuki ..... F02M 35/1034
2019/0301410 A1* 10/2019 Ikeya ..... F02F 1/425

FOREIGN PATENT DOCUMENTS

JP 2002-235546 A 8/2002

* cited by examiner

*Primary Examiner* — Xiao En Mo
(74) *Attorney, Agent, or Firm* — McGinn IP Law Group, PLLC

(57) ABSTRACT

An intake device of an internal combustion engine includes a partition, a gap, and a projecting part. The partition divides an interior of an intake pipe into a first passage and a second passage. The gap exists at a boundary between an inner face of the intake pipe and the partition or in the partition, and couples the first passage and the second passage. The projecting part is disposed near the gap on a face of the partition or the inner face of the intake pipe that forms an inner face of the first passage, or on a face of the partition or the inner face of the intake pipe that forms an inner face of the second passage.

20 Claims, 6 Drawing Sheets

INTAKE DEVICE OF INTERNAL COMBUSTION ENGINE

CROSS-REFERENCE TO RELATED APPLICATIONS

The present application claims priority from Japanese Patent Application No. 2018-100436 filed on May 25, 2018, the entire contents of which are hereby incorporated by reference.

BACKGROUND

The disclosure relates to an intake device of an internal combustion engine.

In the related art, an intake device of an internal combustion engine in which the interior of an intake pipe is divided into a first passage and a second passage by a partition is known. For instance, the intake device described in Japanese Unexamined Patent Application Publication No. 2002-235546 includes a partition that demarcates a main port as the first passage and a swirl port as the second passage, with which swirls are generated inside the cylinder.

SUMMARY

An aspect of the disclosure provides an intake device of an internal combustion engine, including: a partition that divides an interior of an intake pipe into a first passage and a second passage; a gap, existing at a boundary between an inner face of the intake pipe and the partition or in the partition, that couples the first passage and the second passage; and a projecting part that is disposed near the gap on a face of the partition or the inner face of the intake pipe that forms an inner face of the first passage, or on a face of the partition or the inner face of the intake pipe that forms an inner face of the second passage.

DETAILED DESCRIPTION

Figure 1:
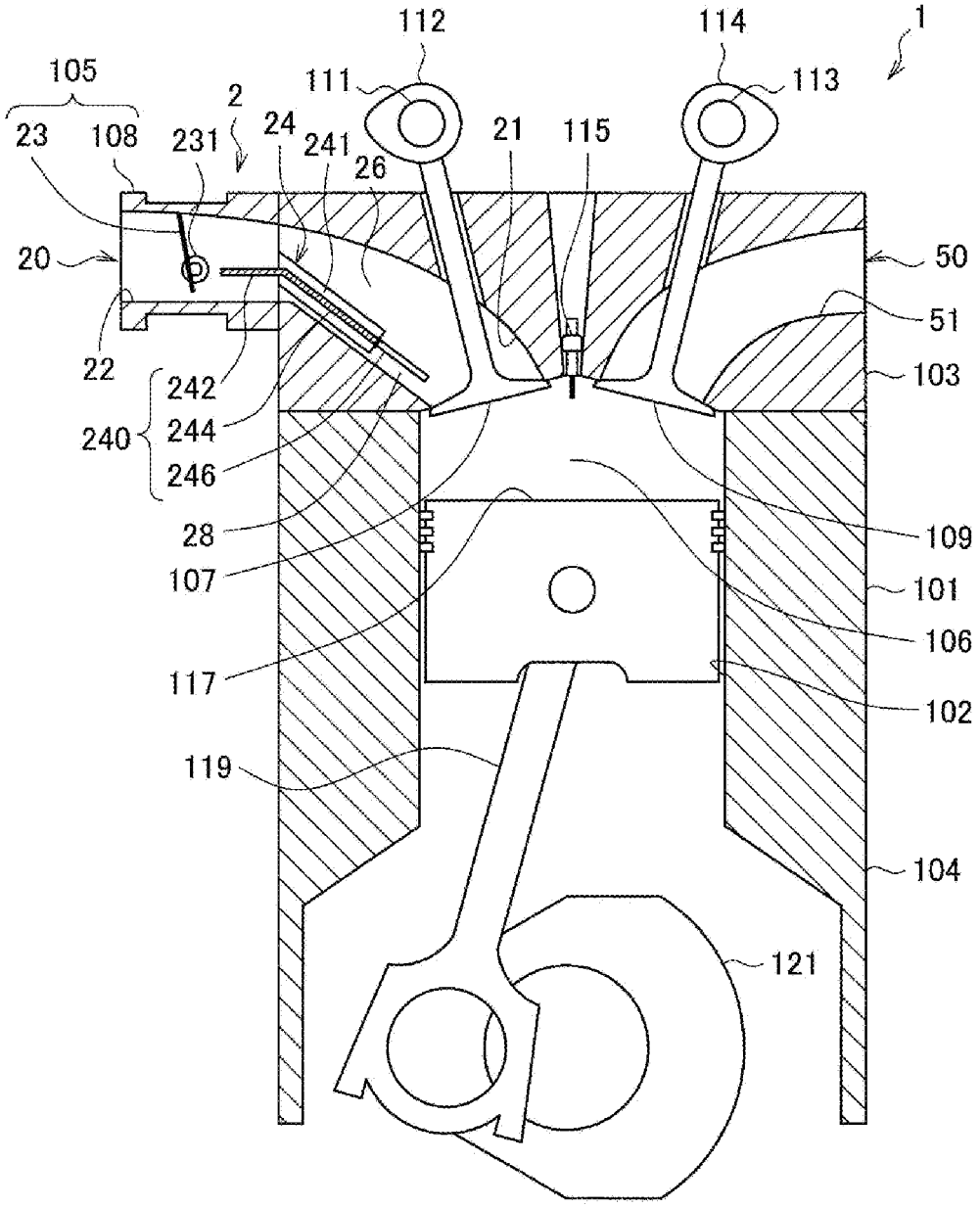
FIG. 1 is a cross-section diagram illustrating a schematic configuration of an engine according to a first embodiment of the disclosure.

In the following, some preferred but non-limiting embodiments of the disclosure are described in detail with reference to the accompanying drawings. Note that sizes, materials, specific values, and any other factors illustrated in respective embodiments are illustrative for easier understanding of the disclosure, and are not intended to limit the scope of the disclosure unless otherwise specifically stated. Further, elements in the following example embodiments which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings. The drawings are schematic and are not intended to be drawn to scale.

In some cases, a gap coupling the first passage and the second passage exists at the boundary between the inner face of the intake pipe and the partition, or in the partition. Because of gas circulating from one passage to the other passage through this gap, there is a risk of lowered controllability of the intake.

Accordingly, it is desirable to provide a novel and improved intake device of an internal combustion engine capable of improving the ability to control the intake.

First Embodiment

First, FIGS. 1 to 3 will be referenced to describe a configuration of an intake device of an internal combustion engine (hereinafter, engine) according to a first embodiment.

[Configuration of Internal Combustion Engine]

FIG. 1 illustrates a cross-section of a single cylinder in an engine 1 of the present embodiment. The engine 1 is what is called a four-stroke gasoline engine which is mounted on-board an automobile and functions as a source of power for traction in the automobile. As illustrated in FIG. 1, the engine 1 includes a cylinder block 101, a cylinder head 103, a valve unit 105, an intake valve 107, an exhaust valve 109, an intake cam shaft 111, an exhaust cam shaft 113, a spark plug 115, a piston 117, a con rod 119, and a crank shaft 121.

In the cylinder block 101, an approximately cylindrical cylinder bore 102 is formed. The cylinder head 103 is disposed installed on the cylinder block 101. A crankcase 104 is provided as the same body of the cylinder block 101. A crank chamber is formed inside the crankcase 104. The crank chamber houses and allows free rotation of the crank shaft 121.

The cylinder bore 102 slidably houses the piston 117. The space demarcated by the cylinder head 103, the cylinder bore 102, and the piston 117 functions as a combustion chamber 106. The shape of the combustion chamber 106 on the cylinder head 103 side is what is called a pent roof. The small end of the con rod 119 is supported by the piston 117 through a pin. The large end of the con rod 119 is rotatably supported by the crank shaft 121. The piston 117 is joined to the crank shaft 121 through the con rod 119.

An intake port 21 and an exhaust port 51 are formed in the cylinder head 103. Both of the ports 21 and 51 are tubular, and each splits into two branches to couple with the combustion chamber 106 (see FIG. 2). In the cylinder head 103, two intake valves 107 and two exhaust valves 109 are installed. The intake cam shaft 111 extends substantially parallel to the crank shaft 121 in the direction in which the two intake valves 107 are lined up. The exhaust cam shaft 113 extends substantially parallel to the crank shaft 121 in the direction in which the two exhaust valves 109 are lined up.

One end of each intake valve 107 is positioned inside the combustion chamber 106, at or near the site where the intake port 21 opens to the combustion chamber 106. The other end of each intake valve 107 abuts an intake cam 112. The intake cam 112 is rotationally driven by the intake cam shaft 111. The rotation of the intake cam 112 causes the intake valve 107 to move reciprocally. With this arrangement, the intake valve 107 opens and closes the space between the intake port 21 and the combustion chamber 106. Similarly, an exhaust cam 114 is rotationally driven by the exhaust cam shaft 113, thereby causing the exhaust valve 109 to move reciprocally. With this arrangement, the exhaust valve 109 opens and closes the space between the exhaust port 51 and the combustion chamber 106.

The spark plug 115 is installed in the cylinder head 103. The tip of the spark plug 115 projects into the interior of the combustion chamber 106 at a position substantially overlapping the axis of the cylinder bore 102 and surrounded by the intake port 21 and the exhaust port 51.

In the intake stroke of the engine 1, by opening the intake valve 107 and also increasing the volume of the combustion chamber 106, a mixture of air and fuel flows into the combustion chamber 106 through the intake port 21. The intake port 21 functions as an intake pipe 20. In the compression stroke after the intake stroke, the air-fuel mixture in the combustion chamber 106 is compressed. When the spark plug 115 produces a spark at a predetermined timing, the air-fuel mixture is ignited and burns. With this arrangement, the volume of the combustion chamber 106 increases (combustion stroke). After that, by opening the exhaust valve 109 and also decreasing the volume of the combustion chamber 106, the spent air-fuel mixture flows out from the combustion chamber 106 through the exhaust port 51 (exhaust stroke). The exhaust port 51 functions as an exhaust pipe 50. In this way, the piston 117 performs a reciprocating motion by combustion. The reciprocating motion is converted into the rotary motion of the crank shaft 121 through the con rod 119.

[Configuration of Intake Device]

As illustrated in FIG. 1, the valve unit 105 is installed in an opening on the opposite side from the combustion chamber 106 in the intake port 21. The valve unit 105 includes a communicating member 108 and a tumble generation valve (TGV) 23. Inside the communicating member 108, a passage 22 is formed. The passage 22 is coupled to the intake port 21 and functions as the intake pipe 20. The TGV 23 is installed in the passage 22. The TGV 23 is what is called a butterfly valve, for instance, and adjusts the degree of opening in the passage 22 by having a planar member (valving element) rotate about a shaft 231. The shaft 231 is rotationally driven by an electric motor.

An intake manifold is attached to the valve unit 105. The passage inside the intake manifold is coupled to the passage 22 of the communicating member 108, and functions as the intake pipe 20. A throttle body is installed in the intake manifold, and the degree of opening in the passage of the intake manifold is adjusted by a throttle valve.

A partition 24 is installed in the intake pipe 20. The intake pipe 20 and the partition 24 function as an intake device 2 of the engine 1. FIG. 2 is a schematic diagram of the intake pipe 20, the combustion chamber 106, and the exhaust pipe 50 as viewed from the side of the cylinder block 101. Hereinafter, the terms upstream, midstream, and downstream refer to upstream, midstream, and downstream in the flow direction of the vapor in the intake pipe 20.

The partition 24 includes a main body 240 and a joining part 241. The main body 240 is formed from a metal material for instance, and is shaped like a plate. The main body 240 includes an upstream part 242, a midstream part 244, and a downstream part 246. The upstream part 242 is tabular, and is bent with respect to the midstream part 244. The upstream part 242 extends inside the passage 22 of the valve unit 105, in the axial direction (lengthwise direction) of the passage 22, or in other words in the flow direction of the vapor. The midstream part 244 and the downstream part 246 are tabular, and extend inside the intake port 21 in the axial direction (lengthwise direction) of the intake port 21, or in other words in the flow direction of the vapor.

The cross-section of the intake pipe 20 cut in the radial direction (specifically at the location where the TGV 23 and the partition 24 are provided) is substantially rectangular. The main body 240 extends substantially parallel to the face on the side of the cylinder block 101 in the intake pipe 20. The main body 240 divides the intake pipe 20 into a first passage 26 and a second passage 28. In the interior of the intake pipe 20, the first passage 26 exists on the intake cam shaft 111 side, and the second passage 28 exists on the cylinder block 101 side. In FIG. 2, the partition 24 is viewed from the second passage 28 side. The main body 240 exists at a position biased toward the cylinder block 101 side from the axis of the intake pipe 20 in the radial direction of the intake pipe 20. The cross-sectional channel area (the cross section in the radial direction) of the first passage 26 is greater than the cross-sectional channel area of the second passage 28. The TGV 23 exists in the intake pipe 20 farther upstream than the partition 24 (main body 240), and is able to open and close the first passage 26. The TGV 23 functions as the intake device 2.

The joining part 241 of the partition 24 is formed from a resin material for instance, and is shaped like a semicircular column (rod-shaped/stick-shaped). The joining part 241 is permanently affixed to both sides of the midstream part 244 in the main body 240. As illustrated in FIG. 2, a semicylindrical depression 210 is formed in the inner walls of the intake port 21. The depression 210 extends in the axial direction of the intake port 21. One end on the intake upstream side in the axial direction of the depression 210 opens into the intake port 21 and also the outer wall face of the cylinder head 103. During the assembly of the partition 24, the joining part 241 is inserted into the depression 210 in the axial direction from the opening of the intake port 21, and fits into the depression 210. With this arrangement, the partition 24 is securely installed on the inner wall of the intake port 21. The face on the main body 240 side in the joining part 241 (the face on the opposite side in the radial direction from the outer circumferential face of the semicylindrical shape) is continuous with the inner face of the intake port 21, and functions as part of the inner face.

The width of the downstream part 246 (the dimension in the direction at a right angle to the axial direction of the intake pipe 20) is smaller than the width of the midstream part 244. The width of the downstream part 246 gradually decreases proceeding from the side of the upstream part 242 toward the side of the combustion chamber 106 in the axial direction of the intake pipe 20. A gap 25 exists between both ends in the width direction (the direction at a right angle to the axial direction of the intake pipe 20) of the downstream part 246 and the inner wall of the intake port 21. The gap 25 exists at the boundary between the inner face of the intake port 21 and the partition 24 (main body 240), and couples the first passage 26 and the second passage 28. The width (the dimension in the direction at a right angle to the axial direction of the intake pipe 20) of the gap 25 gradually increases proceeding from the side of the upstream part 242

(upstream side) to the side of the combustion chamber 106 (downstream side) in the axial direction of the intake pipe 20. The average width of the gap 25 is from 1 mm to 2 mm, for instance.

Figure 2:
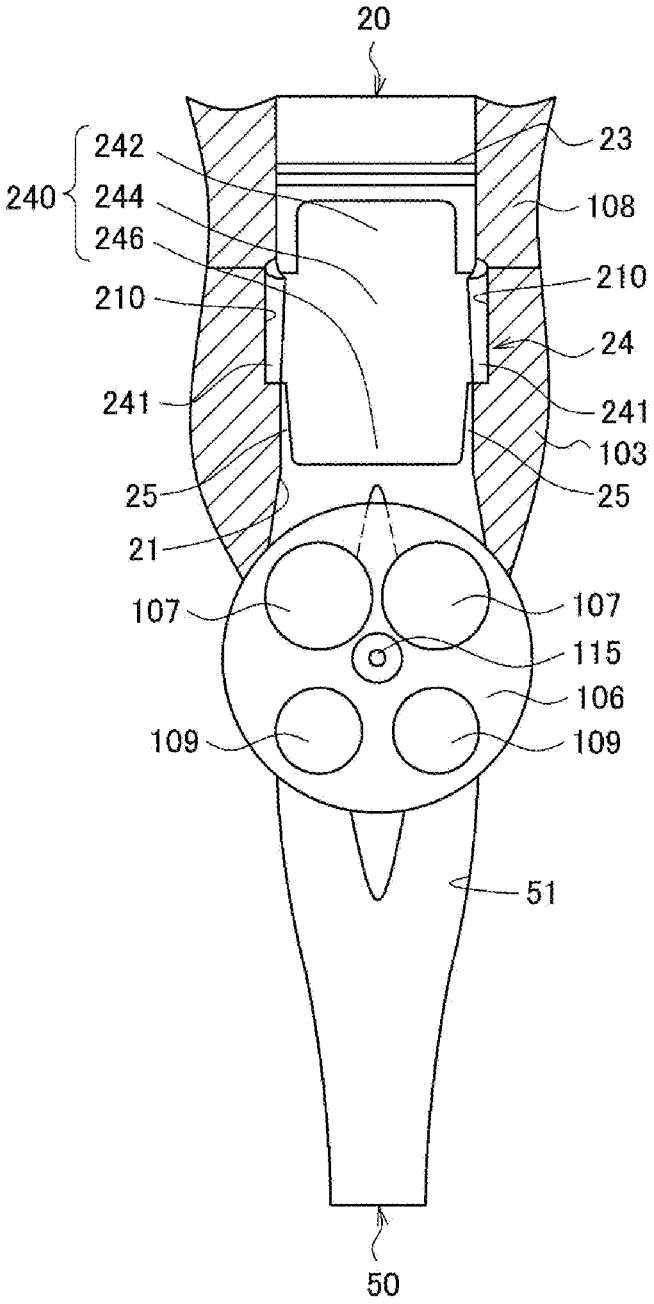
FIG. 2 is a diagram of the engine as viewed from the side of the cylinder block according to the same embodiment.
Figure 3:
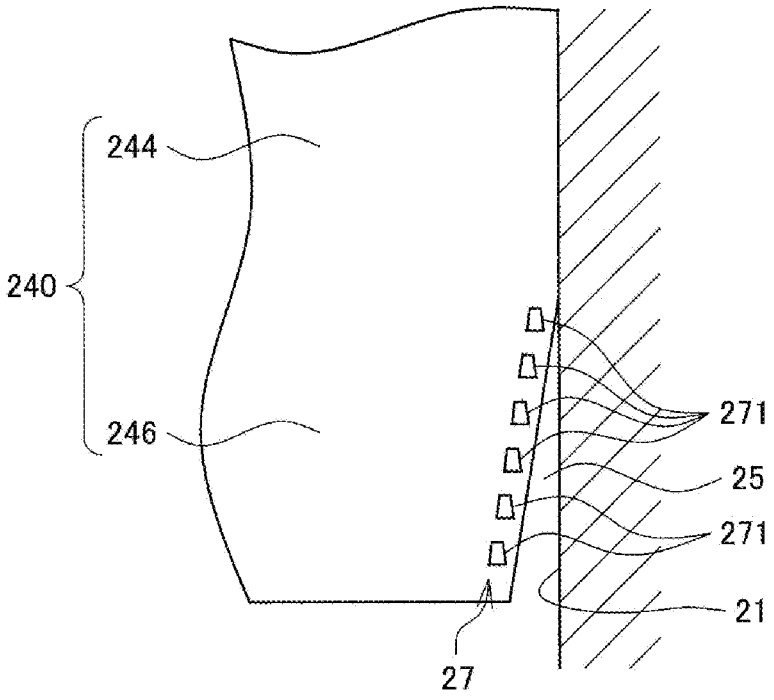
FIG. 3 is a partially enlarged view of the partition according to the same embodiment.

FIG. 3 is a schematic diagram illustrating an enlargement of a portion of the partition 24 (main body 240) in FIG. 2, and illustrates the vicinity of the gap 25. On the face of the downstream part 246 forming the inner face of the second passage 28, a projecting part 27 is formed near the gap 25. The projecting part 27 includes multiple projections 271. Each projection 271 extends into the interior of the second passage 28, and projects up to a predetermined height (for instance, 1 mm) with respect to the face of the downstream part 246. The projections 271 are not continuous with each other. The multiple projections 271 are lined near the gap 25 in a single row along a widthwise end of the downstream part 246.

The shape of each projection 271 is a quadrangular prism. As illustrated in FIG. 3, the shape of each projection 271 as viewed from a direction orthogonal to the face of the downstream part 246 (the normal direction of the face) is approximately trapezoidal, and the width (the dimension in the direction at a right angle to the axial direction of the intake pipe 20) gradually increases proceeding from the side of the upstream part 242 to the side of the combustion chamber 106 in the axial direction of the intake pipe 20. Among the sides of the trapezoid, the three faces forming the upper base and the legs face upstream in the axial direction (flow direction), and have an angle greater than zero with respect to the axial direction (flow direction). Note that the top face of each projection 271 in the normal direction of the face of the downstream part 246 may also face upstream (having the angle described above).

[Effects of Intake Device]

Figure 4:
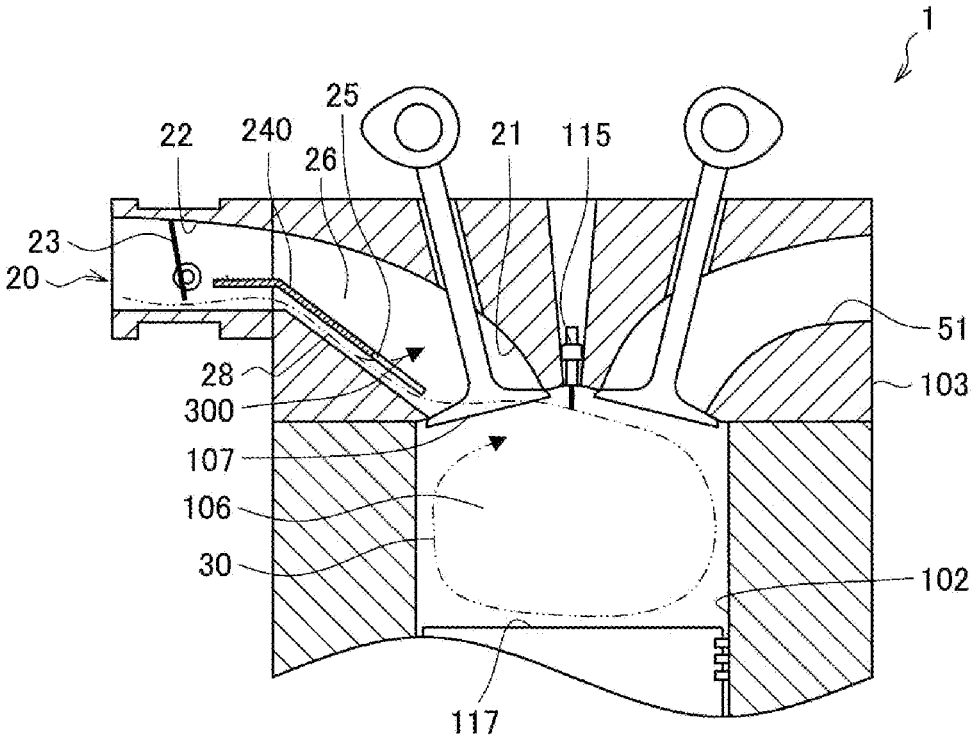
FIG. 4 is a cross-section diagram illustrating the intake stroke of the engine according to the same embodiment.
Figure 5:
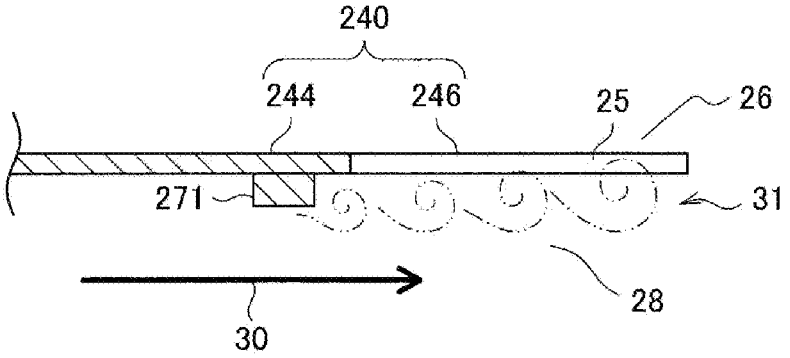
FIG. 5 is a partial cross-section view of the partition illustrating the flow of vapor near a gap according to the same embodiment.
Figure 6:
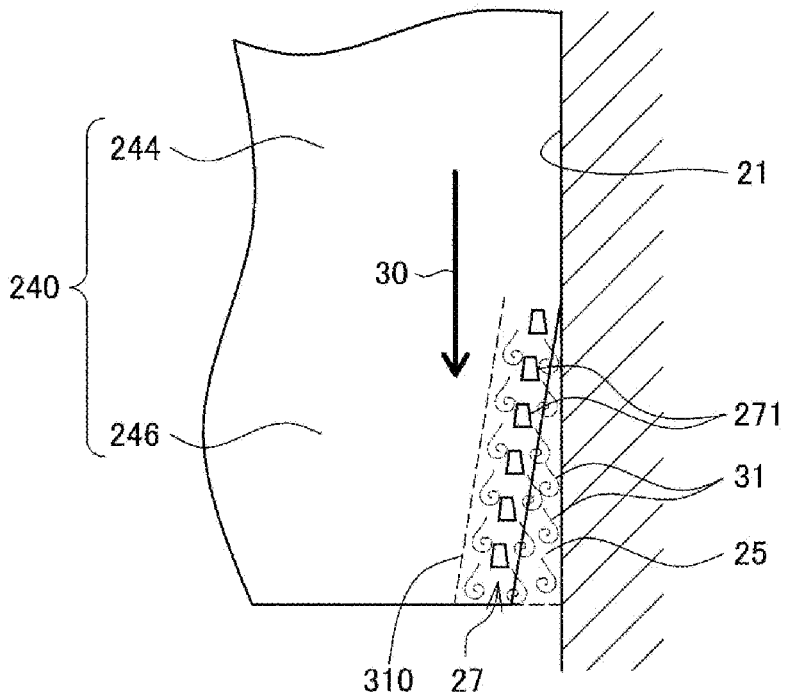
FIG. 6 is a partially enlarged view of the partition illustrating the flow of vapor near gaps according to the same embodiment.

Next, FIGS. 4 to 6 will be referenced to describe the effects of the intake device 2 according to the present embodiment. FIG. 4 is an enlarged view of a portion of FIG. 1, in which the joining part 241 and the projecting part 27 are omitted from illustration. In FIG. 4, the flow of intake (mainstream) in the intake stroke is illustrated by the chain-line arrow 30. As illustrated in FIG. 4, in the intake stroke, vapor passes through the intake pipe 20 and is suctioned into the combustion chamber 106. The intake flowing into the combustion chamber 106 proceeds along to the cylinder bore 102 to the top face of the piston 117, and then flows along the top face to the cylinder head 103 side. With this arrangement, the vapor forms a longitudinal vortex flow (tumble flow) inside the combustion chamber 106. For instance, when the load on the engine 1 is low and the intake amount is small, restricting the cross-sectional channel area of the first passage 26 with the TGV 23 causes the vapor to pass through on the second passage 28 side. When the degree of opening of the TGV 23 reaches a minimum and the first passage 26 is closed off by the valving element of the TGV 23, almost all of the vapor guided into the intake pipe 20 passes through the second passage 28 and proceeds to the combustion chamber 106.

In this way, by narrowing the channel through which vapor passes and decreasing the cross-sectional channel area of the intake pipe 20, the flow rate of the vapor is raised. The inflow of such vapor (air-fuel mixture) with a higher flow rate into the combustion chamber 106 strengthens the tumble flow. If the piston 117 is stroked up to near top dead center in the compression stroke, the tumble flow collapses, a multitude of small turbulent eddies are generated, and the flow rate fluctuation (the turbulent intensity of gas flow) of the intake inside the combustion chamber 106 immediately before ignition increases. If the air-fuel mixture is ignited by the spark plug 115 in this state, fast burn of the fuel is achieved, making it possible to improve fuel efficiency and combustion stability. In this way, by opening and closing the first passage 26, the TGV 23 functions as a control valve for strengthening tumble flow. Note that the top face of the piston 117 may also be shaped to strengthen gas flow, stratified charge combustion, and the like.

The gap 25 exists between the partition 24 (downstream part 246) and the intake port 21. Therefore, as indicated by the arrow 300 in FIG. 4, there is a risk of vapor (part of the mainstream) leaking out from the second passage 28, through the gap 25, and into the first passage 26. If vapor leaks out from the second passage 28 in this way, the flow rate of the intake flowing into the combustion chamber 106 falls, and therefore there is a risk that the tumble flow in the combustion chamber 106 may not be strengthened sufficiently and the expected gas flow (the intended in-cylinder flow) may not be obtained.

In contrast, in the present embodiment, the projecting part 27 (multiple projections 271) exists near the gap 25 on the face of the partition 24 forming the inner face of the second passage 28. FIG. 5 is a cross-section of a portion of the partition 24 (main body 240) near the gap 25 taken in the axial direction of the intake pipe 20, and schematically illustrates a mainstream 30 and turbulent eddies 31 of vapor. FIG. 6 is a diagram similar to FIG. 3, and schematically illustrates the mainstream 30 and the turbulent eddies 31 of vapor.

As illustrated in FIG. 5, turbulent eddies 31 are generated on the downstream side of a projection 271. A turbulent flow including the turbulent eddies 31 is generated extending toward the gap 25. Also, due to the generation of the turbulent eddies 31 on the downstream side of each projection 271, as illustrated enclosed between dashed lines in FIG. 6, a turbulence field 310 that works to cover the gap 25 is formed. By interposing the turbulent eddies 31 in the gap 25 in this way, the leaking out of vapor from the second passage 28, through the gap 25, and into the first passage 26 is moderated. Since the leaking out of vapor indicated by the arrow 300 in FIG. 4 is blocked by the turbulent eddies 31, gas circulation between the first passage 26 and the second passage 28 is moderated. Therefore, since the drop in the flow rate of intake flowing into the combustion chamber 106 is moderated, the drop in the function of strengthening the tumble flow (the controllability of the gas flow) in the combustion chamber 106 may be moderated. In other words, the controllability of intake may be improved.

Note that since the effective cross-sectional channel area of the second passage 28 becomes smaller (the effective channel diameter becomes narrower) as the layer of turbulent flow becomes thicker, to that extent, the flow rate of the vapor flowing through the second passage 28 becomes faster. Therefore, the drop in the flow rate of intake flowing into the combustion chamber 106 is moderated more effectively. Also, when the flow rate of vapor flowing through the second passage 28 is high, the turbulent eddies 31 generated downstream of the projections 271 and interposed in the gap 25 become larger. Therefore, at fast flow rates when there is a high risk of vapor circulating between the first passage 26 and the second passage 28 through the gap 25, the effect of moderating the circulation may be increased automatically.

The distance (in the axial direction or the width direction) between the projections 271 and the gap 25 may be set to a distance such that when the flow rate of vapor flowing through the second passage 28 is a predetermined speed, the turbulent eddies 31 produced by the projections 271 overlap with at least part of the gap 25. If the turbulent eddies 31 overlap at least part of the gap 25, the circulation between the first passage 26 and the second passage 28 in the overlapping part is moderated, and the above operational advantage is obtained. Note that the gap 25 is not limited to being at the boundary between the inner face of the intake pipe 20 and the partition 24, and may also be in the partition 24.

At this point, to moderate gas circulation through the gap 25, instead of providing the projecting part 27 (multiple projections 271) near the gap 25, it is also conceivable to fill the gap 25 with the partition 24 (main body 240) or the like. However, in the case in which the partition 24 is formed as a separate member from the intake pipe 20 and is assembled in the interior of the intake pipe 20, the gap 25 may occur due to assembly inconsistencies. In other words, if the dimensions (tolerances) are set in advance such that a predetermined gap 25 occurs between the inner face of the intake pipe 20 and the partition 24, ease of assembly may be improved and costs may be reduced. Also, situations in which the partition 24 and the inner wall of the intake pipe 20 interfere with each other due to assembly inconsistencies may be moderated.

Alternatively, in the case in which the partition 24 includes the main body 240 and the joining part 241 like the present embodiment, inconsistencies in the assembly of the joining part 241 and the main body 240 may also cause the gap 25 to occur (between the joining part 241 and the main body 240). Therefore, from the perspective of improving ease of assembly and the like, it is convenient if the gap 25 coupling the first passage 26 and the second passage 28 exists at the boundary between the inner face of intake pipe 20 and the partition 24, or in the partition 24. Additionally, cases in which the gap 25 is provided are also conceivable for other reasons. In the case in which the gap 25 exists in this way, by providing the projecting part 27 (multiple projections 271) near the gap 25, it is possible to moderate gas circulation through the gap 25.

Note that the gap 25 is not limited to the downstream side of the partition 24, and may also exist on the midstream side or the upstream side. The shape of the gap 25 is not limited to being wedge-shaped (triangular) like the present embodiment, and may also be rectangular (oblong) or the like. Also, the edges of the members that form the gap 25 are not limited to being linear, and may also be curved. The gap 25 may also exist on only one side of the partition 24 in the width direction (the direction at a right angle to the axial direction of the intake pipe 20) of the partition 24.

Also, the shape of the radial cross-section of the intake pipe 20 is not limited to being square, and may also be circular, elliptical, or the like. The shape of the partition 24 (main body 240) does not have to be tabular. For instance, in the case in which the inner wall of the intake pipe 20 is curved, the partition 24 (main body 240) may also be curved to follow the inner wall of the intake pipe 20 proceeding from the upstream side to the downstream side of the intake pipe 20. The width of the partition 24 (main body 240) does not have to be constant. For instance, in the case in which the inner diameter of the intake pipe 20 varies, the width of the partition 24 (main body 240) may also vary to follow the variation in the inner diameter of the intake pipe 20 proceeding from the upstream side to the downstream side of the intake pipe 20.

the material of the main body 240 is not limited to metal, and may also be resin or the like. Any method may be used to attach the partition 24 to the inner wall of the intake pipe 20, and the partition 24 is affixable to the intake pipe 20 by rivets, welding, or the like. Also, the partition 24 may be formed in the intake pipe 20 (intake port 21) by pouring in a separate metal plate when casting the cylinder head 103. It is sufficient for the partition 24 to exist in the intake pipe 20, and is not limited to the intake port 21 and may also be installed at the intake manifold or the like.

It is sufficient for the projecting part 27 (multiple projections 271) to be near the gap 25, and rather than being on the face of the partition 24, may be on an inner face of the intake pipe 20 such as the intake port 21 (forming the inner face of the second passage 28). In the present embodiment, since the projecting part 27 (multiple projections 271) are on the side of the partition 24, providing the projecting part 27 (multiple projections 271) near the gap 25 is relatively easy. In the present embodiment, the partition 24 includes the main body 240 and the joining part 241. In the case in which the gap 25 is between the main body 240 and the joining part 241 (facing opposite the main body 240, the projecting part 27 may also be on the joining part 241 near the gap 25. Note that the joining part 241 may also be omitted.

The projecting part 27 (multiple projections 271) is on the upstream side of the gap 25 in the axial direction of the intake pipe 20. In other words, each projection 271 overlaps with the gap 25 in the direction of flow in the second passage 28. Therefore, since a turbulent flow including the turbulent eddies 31 generated downstream of the projecting part 27 (multiple projections 271) in this flow direction extends toward the gap 25, it is easy for the turbulent eddies 31 (turbulence field 310) to overlap the gap 25.

The projecting part 27 includes multiple projections 271. The multiple projections 271 are not continuous with each other, and the projecting part 27 is intermittent. Therefore, by appropriately changing the arrangement, spacing, size, and shape of the multiple projections 271, it is easy to adjust the size (thickness) and range of the turbulence field 310 generated by the projecting part 27. In the present embodiment, the multiple projections 271 share the same shape and size, and are lined up in a single row along a widthwise end (gap 25) of the main body 240, but are not limited thereto.

For instance, on the upstream side rather than the downstream side of the direction of flow in the second passage 28, the multiple projections 271 may be disposed densely, may be disposed in multiple rows in the width direction, or the individual projections 271 may be widened or raised in height. Near a location where the gap 25 is wide rather than narrow, the multiple projections 271 may be disposed densely, may be disposed in multiple rows in the width direction, or the individual projections 271 may be widened or raised in height. With this arrangement, it is possible to make the turbulent eddies 31 (turbulence field 310) overlap the gap 25 effectively.

On the other hand, if the turbulence field 310 becomes too thick, there is a risk that the amount of vapor (intake amount) flowing through the second passage 28 may become less and the output of the engine 1 may drop. For this reason, the arrangement and size/shape of the multiple projections 271 may be set such that the thickness of the turbulence field 310 is a predetermined thickness or less.

Each projection 271 may be shaped in any way. The shape may be tabular, may be conical or frustum-shaped, or may be like a round or square pillar. The surface of each projection 271 may be flat or curved. The edges on the upstream side of the projections 271 may also be obtuse. The shape of the projections 271 may also be adjusted such that the extension direction of the turbulent flow generated on the downstream side of the projections 271 becomes a direction proceeding toward the gap 25 at an angle greater than zero with respect to the flow direction of the mainstream 30 in the second passage 28. For instance, the projections 271 may have a tabular shape extending toward the gap 25 at the above angle.

The projecting part 27 (multiple projections 271) may be formed by any method. Each projection 271 may also be a tab formed in the main body 240 by a press process such as a punch press. The projections 271 may also be created separately from the main body 240 or the like, and installed on a face near the gap 25. Also, a sheet having the projections 271 may be created and affixed to a face near the gap 25.

Second Embodiment

Figure 7:
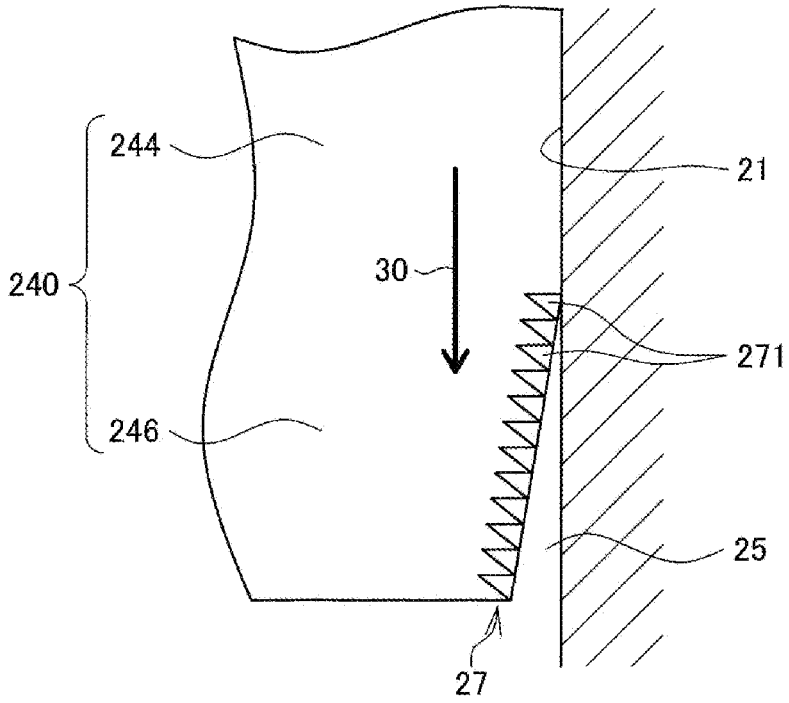
FIG. 7 is a partially enlarged view of the partition according to a second embodiment of the disclosure.

Next, FIG. 7 will be referenced to describe an intake device of an internal combustion engine according to the second embodiment. The present embodiment is a modification of the projecting part 27 in the first embodiment. FIG. 7 is a schematic diagram similar to FIG. 3 of a portion of the partition 24 (main body 240) in the second embodiment. The projecting part 27 includes multiple projections 271. Each projection 271 is tabular and extends in the normal direction of the face of the downstream part 246. Adjacent projections 271 are coupled to each other at acute angles. The multiple projections 271 are continuous in an alternating bent pattern. The projecting part 27 (multiple continuous projections 271) extends along a widthwise end (gap 25) of the downstream part 246.

In this way, since the multiple projections 271 are joined in a zig-zag pattern, the substantial surface area of the projecting part 27 facing upstream in the axial direction of the intake pipe 20 (the flow direction in the second passage 28) is increased, making it possible to generate larger turbulent eddies 31 easily. Since the rest of the configuration and other effects are the same as the first embodiment, a description is omitted.

Third Embodiment

Figure 8:
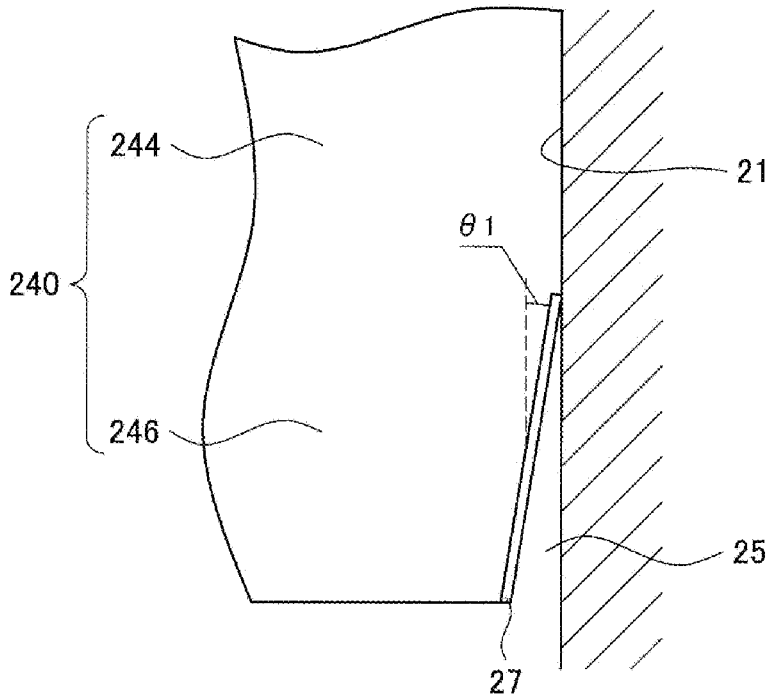
FIG. 8 is a partially enlarged view of the partition according to a third embodiment of the disclosure.
Figure 9:
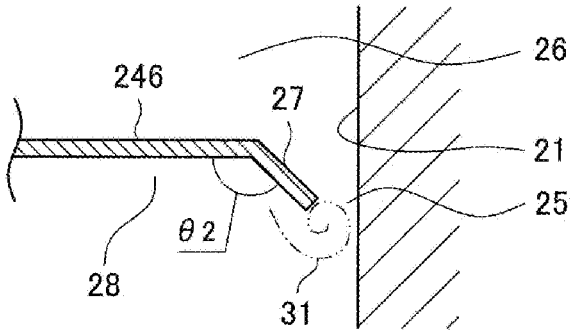
FIG. 9 is a partial cross-section view of the partition illustrating the flow of vapor near a gap according to the same embodiment.

Next, FIGS. 8 and 9 will be referenced to describe an intake device of an internal combustion engine according to the third embodiment. The present embodiment is a modification of the projecting part 27 in the first embodiment. FIG. 8 is a schematic diagram similar to FIG. 3 of a portion of the partition 24 (main body 240) in the third embodiment. FIG. 9 is a cross-section, taken in the radial direction of the intake pipe 20, of a portion of the partition 24 (main body 240) in the present embodiment. The projecting part 27 extends along a widthwise end (gap 25) of the downstream part 246. The projecting part 27 is a widthwise end (side edge) of the downstream part 246 facing opposite the inner face of the intake pipe 20, and the end is bent toward the interior of the second passage 28. As illustrated in FIG. 8, the projecting part 27 faces upstream in the axial direction of the intake pipe 20 (the flow direction in the second passage 28), and has an angle θ1 greater than zero with respect to the axial direction (flow direction). As illustrated in FIG. 9, on the inner face of the second passage 28, the angle θ2 obtained by the projecting part 27 with respect to the downstream part 246 is an obtuse angle.

In this way, by having the projecting part 27 near the gap 25, as illustrated in FIG. 9, the flow proceeding to the gap 25 separates. The flow passing over the projecting part 27 generates turbulent eddies 31, and a turbulent flow extending toward the gap 25 is generated. A turbulence field 310 overlapping the gap 25 is formed. Since it is sufficiently to simply provide the angle θ2 on the widthwise end of the downstream part 246, the projecting part 27 may be formed easily by a press process or the like. Since the rest of the configuration and other effects are the same as the first embodiment, a description is omitted.

Although the preferred embodiments of the disclosure have been described in detail with reference to the appended drawings, the disclosure is not limited thereto. It is obvious to those skilled in the art that various modifications or variations are possible insofar as they are within the technical scope of the appended claims or the equivalents thereof. It should be understood that such modifications or variations are also within the technical scope of the disclosure.

For instance, in the above embodiments, the control valve inside the intake pipe is taken to be a TGV to strengthen the tumble flow, but may also be a swirl control valve to strengthen the transverse vortex flow (swirl flow), or another type of valve. A throttle valve may also be provided with the function of a TGV or swirl control valve. The valving element of the control valve installed in the intake pipe may also double as a partition. In other words, the valving element of the control valve may narrow the intake pipe while also having a projecting part that exists near the gap between the valving element and the intake pipe in the state in which the valving element divides interior of the intake pipe into first and second passages.

Additionally, the disclosure may also be applied to an intake device without a control valve or a throttle valve. For instance, to achieve stratified charge combustion, the partition may also have a function of demarcating a passage through which an air-fuel mixture circulates and a passage through which air circulates. In this case, if gas leaks out from one passage, through the gap, and into the other passage, there is a risk that the expected stratified charge combustion may not be obtained. By having a projecting part exist near the gap on an inner face of either passage, the circulation of gas between the passages may be moderated. The point is that by providing a projecting part near the gap on an inner face of a passage (the first passage or the second passage) containing some kind of gas flow, it is possible to moderate the circulation of gas between the passages.

In the above embodiments, the internal combustion engine is taken to be a four-stroke gasoline engine, but the disclosure may also be applied to an intake device of a two-stroke engine or a diesel engine. For instance, in the case in which a partition is provided to strengthen a swirl flow in an intake device of a diesel engine, the leaking out of vapor from one passage to another passage demarcated by the partition may be moderated by a projecting part near the gap.

The position at which to inject fuel in the intake pipe may be upstream or downstream of the partition. Also, the engine is not limited to being one that injects fuel into the intake pipe, and the disclosure may also be applied to an intake device of an engine that injects fuel directly into the combustion chamber. In other words, the vapor passing through the intake pipe is not limited to an air-fuel mixture, and may also be air. Also, in the above embodiments, the internal combustion engine is taken to be a reciprocating engine, but the disclosure may also be applied to an intake device of a rotary engine. In addition, the disclosure is applicable to an intake device of not only an engine that uses gasoline or diesel as fuel, but also an engine that uses natural gas or the like. Furthermore, the disclosure is applicable to an intake device of not only the engine of an automobile, but also the engine of a ship or airplane.

According to the embodiments of the disclosure as described above, by having a projecting part exist near a gap, turbulent eddies are interposed in at least a part of the gap. Therefore, since the circulation of gas between passages through the gap is moderated, the controllability of intake may be improved.

The invention claimed is:

1. An intake device of an internal combustion engine, comprising:

a partition that divides an interior of an intake pipe into a first passage and a second passage;

a fixed gap, at a boundary between an inner face of the intake pipe and the partition or in the partition, that links the first passage and the second passage; and a projecting part that is disposed near the fixed gap on a face of the partition or the inner face of the intake pipe that forms an inner face of the first passage, or on a face of the partition or the inner face of the intake pipe that forms an inner face of the second passage.

2. The intake device of an internal combustion engine according to claim 1, wherein at least a part of the projecting part is disposed on an upstream side of the fixed gap in a flow direction of a vapor in the intake pipe.

3. The intake device of an internal combustion engine according to claim 1, wherein a distance between the projecting part and the fixed gap is a distance at which a turbulent eddy of a vapor generated by the projecting part overlaps at least a part of the fixed gap.

4. The intake device of an internal combustion engine according to claim 2, wherein a distance between the projecting part and the fixed gap is a distance at which a turbulent eddy of a vapor generated by the projecting part overlaps at least a part of the fixed gap.

5. The intake device of an internal combustion engine according to claim 1, wherein the projecting part comprises multiple projections.

6. The intake device of an internal combustion engine according to claim 2, wherein the projecting part comprises multiple projections.

7. The intake device of an internal combustion engine according to claim 5, wherein the multiple projections are continuous and in an alternating bent pattern.

8. The intake device of an internal combustion engine according to claim 6, wherein the multiple projections are in an alternating bent pattern that is continuous.

9. The intake device of an internal combustion engine according to claim 1, wherein the projecting part is a side edge of the partition facing opposite the inner face of the intake pipe, and is a portion bent toward the first passage or the second passage.

10. The intake device of an internal combustion engine according to claim 2, wherein the projecting part is a side edge of the partition facing opposite the inner face of the intake pipe, and is a portion bent toward the first passage or the second passage.

11. The intake device of an internal combustion engine according to claim 1, comprising:

a control valve disposed inside the intake pipe and capable of opening and closing the first passage, wherein the projecting part is disposed on the face of the partition or the inner face of the intake pipe forming the inner face of the second passage.

12. The intake device of an internal combustion engine according to claim 2, comprising:

a control valve disposed inside the intake pipe and capable of opening and closing the first passage, wherein the projecting part is disposed on the face of the partition or the inner face of the intake pipe forming the inner face of the second passage.

13. An intake device of an internal combustion engine, comprising:

a partition that divides an interior of an intake pipe into a first passage and a second passage;

a fixed gap, formed from a boundary between an inner face of the intake pipe and the partition or in the partition, that provides a conduit between the first passage and the second passage; and a projecting part that is formed near the fixed gap on a face of the partition or the inner face of the intake pipe.

14. The intake device of an internal combustion engine according to claim 13, wherein at least a part of the projecting part is disposed on an upstream side of the fixed gap in a flow direction of a vapor in the intake pipe.

15. The intake device of an internal combustion engine according to claim 13, wherein a distance between the projecting part and the fixed gap is a distance at which a turbulent eddy of a vapor generated by the projecting part overlaps at least a part of the fixed gap.

16. The intake device of an internal combustion engine according to claim 14, wherein a distance between the projecting part and the fixed gap is a distance at which a turbulent eddy of a vapor generated by the projecting part overlaps at least a part of the fixed gap.

17. The intake device of an internal combustion engine according to claim 13, wherein the projecting part comprises multiple projections.

18. The intake device of an internal combustion engine according to claim 14, wherein the projecting part comprises multiple projections.

19. The intake device of an internal combustion engine according to claim 17, wherein the multiple projections form a continuous pattern that is an alternating bent pattern, and wherein each of the multiple projecting parts is a side edge of the partition facing opposite the inner face of the intake pipe, and is a portion bent toward the first passage or the second passage.

20. The intake device of an internal combustion engine according to claim 13, further comprising:

a control valve disposed inside the intake pipe and capable of opening and closing the first passage, wherein the projecting part is disposed on the face of the partition or the inner face of the intake pipe forming the inner face of the second passage.

* * * * *